US010561286B2

(12) United States Patent
Conrad

(10) Patent No.: US 10,561,286 B2
(45) Date of Patent: Feb. 18, 2020

(54) CONFIGURATION OF A SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 47 days.

(21) Appl. No.: 15/406,434

(22) Filed: Jan. 13, 2017

(65) Prior Publication Data

US 2017/0119221 A1 May 4, 2017

Related U.S. Application Data

(63) Continuation of application No. 14/470,342, filed on Aug. 27, 2014, now abandoned, which is a continuation of application No. 12/721,128, filed on Mar. 10, 2010, now Pat. No. 8,950,039, which is a continuation-in-part of application No. 12/675,512, (Continued)

(30) Foreign Application Priority Data

Aug. 29, 2007 (CA) ..... 2599303
Mar. 11, 2009 (CA) ..... 2658005

(51) Int. Cl.

| | |
|---|---|
| ***A47L 9/10*** | (2006.01) |
| ***A47L 5/22*** | (2006.01) |
| ***A47L 5/24*** | (2006.01) |
| ***A47L 5/36*** | (2006.01) |
| ***A47L 9/16*** | (2006.01) |
| ***A47L 9/32*** | (2006.01) |

(52) U.S. Cl.

CPC ..... *A47L 5/225* (2013.01); *A47L 5/24* (2013.01); *A47L 5/36* (2013.01); *A47L 9/1625* (2013.01); *A47L 9/1641* (2013.01); *A47L 9/1666* (2013.01); *A47L 9/1683* (2013.01); *A47L 9/327* (2013.01)

(58) Field of Classification Search

CPC ..... A47L 5/225; A47L 5/24; A47L 9/1625; A47L 9/1666; A47L 9/1683; A47L 9/327

USPC ..... 15/320, 321, 347, 353

See application file for complete search history.

(56) References Cited

U.S. PATENT DOCUMENTS 2,071,975 A 2/1937 Holm-Hansen et al.
2,533,057 A 12/1950 Senne (Continued)

FOREIGN PATENT DOCUMENTS

CA 1218962 A1 3/1987
CA 2241644 A1 12/2007

(Continued)

OTHER PUBLICATIONS

English machine translation of CN1626025A, published on Oct. 15, 2005.

(Continued)

*Primary Examiner* — Joseph J Hail
*Assistant Examiner* — Shantese L McDonald
(74) *Attorney, Agent, or Firm* — Philip C. Mendes da Costa; Bereskin & Parr LLP/S.E.N.C.R.L, s.r.l.

(57) ABSTRACT

A reconfigurable upright surface cleaning apparatus has a surface cleaning unit removably mounted to the floor cleaning unit. The surface cleaning unit has a rear air inlet and a front air outlet.

17 Claims, 10 Drawing Sheets

Related U.S. Application Data filed as application No. PCT/CA2008/001531 on Aug. 28, 2008, now abandoned, said application No. 12/721,128 is a continuation-in-part of application No. 12/675,540, filed as application No. PCT/CA2008/001530 on Aug. 28, 2008, now Pat. No. 9,027,201, said application No. 12/721,128 is a continuation-in-part of application No. 12/675,636, filed as application No. PCT/CA2008/001519 on Aug. 27, 2008, now abandoned.

(56) References Cited

U.S. PATENT DOCUMENTS 2,542,634 A 2/1951 Davis et al.
2,559,384 A 7/1951 Anderson, Jr. et al.
2,621,756 A 12/1952 Senne
2,632,524 A 3/1953 Senne
2,913,111 A 11/1959 Rogers
2,942,691 A 6/1960 Dillon
3,015,122 A 1/1962 Cook
3,130,157 A 4/1964 Kelsall et al.
3,200,568 A 8/1965 McNeil
3,310,828 A 3/1967 Clark et al.
3,320,727 A 5/1967 Farley et al.
3,356,334 A 12/1967 Scaramucci
3,457,744 A 7/1969 Bisbing
3,530,649 A 9/1970 Porsch et al.
3,582,616 A 6/1971 Wrob
3,822,533 A 7/1974 Oranje
3,898,068 A 8/1975 McNeil
3,988,132 A 10/1976 Oranje
3,988,133 A 10/1976 Schady
4,187,088 A 2/1980 Hodgson
4,236,903 A 12/1980 Malmsten
4,373,228 A 2/1983 Dyson
4,393,536 A 7/1983 Tapp
4,443,910 A 4/1984 Fitzwater
4,573,236 A 3/1986 Dyson
4,635,315 A 1/1987 Kozak
4,670,937 A * 6/1987 Sumerau ..... A47L 5/225 15/329
4,826,515 A 5/1989 Dyson
4,831,685 A 5/1989 Bosyj et al.
4,836,515 A 6/1989 Franz et al.
4,905,342 A 3/1990 Ataka
5,054,157 A 10/1991 Werner et al.
5,078,761 A 1/1992 Dyson
5,129,125 A 7/1992 Gamou et al.
5,230,722 A 7/1993 Yonkers
5,287,591 A 2/1994 Rench et al.
5,309,600 A 5/1994 Weaver et al.
5,309,601 A 5/1994 Hampton et al.
5,524,321 A 6/1996 Weaver et al.
5,715,566 A 2/1998 Weaver et al.
5,836,047 A 11/1998 Lee et al.
5,842,254 A 12/1998 Lee
5,858,038 A 1/1999 Dyson et al.
6,058,559 A 5/2000 Yoshimi et al.
6,070,291 A 6/2000 Bair et al.
6,081,961 A 7/2000 Wang
6,210,469 B1 4/2001 Tokar
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,256,832 B1 7/2001 Dyson
6,295,692 B1 10/2001 Shideler
6,406,505 B1 6/2002 Oh et al.
6,434,785 B1 8/2002 Vandenbelt et al.
6,440,197 B1 8/2002 Conrad et al.
6,463,622 B2 10/2002 Wright et al.
6,531,066 B1 3/2003 Saunders et al.
6,553,612 B1 4/2003 Dyson et al.
6,560,818 B1 5/2003 Hasko
6,581,239 B1 6/2003 Dyson et al.
6,599,338 B2 7/2003 Oh et al.
6,623,539 B2 9/2003 Lee et al.
6,736,873 B2 5/2004 Conrad et al.
6,746,500 B1 6/2004 Park et al.
6,776,824 B2 * 8/2004 Wen ..... A47L 5/24 55/485
6,782,583 B2 8/2004 Oh
6,782,585 B1 8/2004 Conrad et al.
6,833,015 B2 12/2004 Oh et al.
6,848,146 B2 2/2005 Wright et al.
6,874,197 B1 4/2005 Conrad et al.
6,902,596 B2 6/2005 Conrad et al.
7,131,165 B2 11/2006 Wright et al.
7,146,681 B2 12/2006 Wright et al.
7,160,346 B2 1/2007 Park
7,222,303 B2 5/2007 Oren et al.
7,222,393 B2 5/2007 Kaffenberger et al.
7,247,181 B2 7/2007 Hansen et al.
7,278,181 B2 10/2007 Harris et al.
7,335,242 B2 2/2008 Oh
7,370,387 B2 5/2008 Walker et al.
7,377,008 B2 5/2008 Park et al.
7,381,234 B2 6/2008 Oh
7,386,916 B2 6/2008 Bone
7,448,363 B1 11/2008 Rasmussen et al.
7,485,164 B2 2/2009 Jeong et al.
7,488,362 B2 2/2009 Jeong et al.
7,540,894 B2 6/2009 Ni
7,547,338 B2 6/2009 Kim et al.
7,581,286 B2 9/2009 Choi
7,584,522 B1 * 9/2009 Weeter ..... A47L 5/30 15/327.6
7,594,296 B2 9/2009 Park
7,597,730 B2 10/2009 Yoo et al.
7,604,675 B2 10/2009 Makarov et al.
7,624,475 B2 12/2009 Choi
7,645,311 B2 1/2010 Oh et al.
7,686,858 B2 3/2010 Oh
7,882,592 B2 2/2011 Hwang et al.
7,887,612 B2 2/2011 Conrad
7,922,794 B2 4/2011 Morphey
7,979,953 B2 7/2011 Yoo
8,032,981 B2 10/2011 Yoo
8,032,983 B2 10/2011 Griffith et al.
8,100,999 B2 1/2012 Ashbee et al.
8,127,398 B2 3/2012 Conrad
8,166,607 B2 5/2012 Conrad
8,191,203 B2 6/2012 Yoo
8,347,455 B2 1/2013 Dyson et al.
8,359,705 B2 1/2013 Conrad
8,444,731 B2 5/2013 Gomiciaga-Pereda et al.
8,468,646 B2 6/2013 Yoo
8,484,799 B2 7/2013 Conrad
8,528,160 B2 9/2013 Conrad
8,769,767 B2 7/2014 Conrad
2002/0011053 A1 1/2002 Oh
2002/0062531 A1 5/2002 Oh
2002/0112315 A1 8/2002 Conrad
2002/0134059 A1 9/2002 Oh
2002/0162188 A1 11/2002 Harmen
2002/0178535 A1 12/2002 Oh et al.
2002/0178698 A1 12/2002 Oh et al.
2002/0178699 A1 12/2002 Oh
2003/0037403 A1 * 2/2003 Lang ..... A47L 5/24 15/330
2003/0046910 A1 3/2003 Lee et al.
2003/0066273 A1 4/2003 Choi et al.
2003/0158238 A1 8/2003 Hale et al.
2003/0159411 A1 8/2003 Hansen et al.
2004/0010885 A1 1/2004 Hitzelberger et al.
2004/0025285 A1 2/2004 McCormick et al.
2004/0112022 A1 6/2004 Vuijk
2004/0163201 A1 8/2004 Murphy et al.
2004/0194251 A1 10/2004 Overvaag et al.
2004/0216263 A1 11/2004 Best et al.
2004/0216264 A1 11/2004 Shaver et al.
2005/0198769 A1 9/2005 Lee et al.
2005/0252179 A1 11/2005 Oh et al.

(56) References Cited

U.S. PATENT DOCUMENTS

2006/0037172 A1 2/2006 Choi
2006/0042038 A1 3/2006 Arnold et al.
2006/0042206 A1 3/2006 Arnold et al.
2006/0080947 A1 4/2006 Lee et al.
2006/0090290 A1 5/2006 Lau
2006/0123590 A1 6/2006 Fester et al.
2006/0137304 A1 6/2006 Jeong et al.
2006/0137305 A1 6/2006 Jung
2006/0137306 A1 6/2006 Jeong et al.
2006/0137309 A1 6/2006 Jeong et al.
2006/0137314 A1 6/2006 Conrad et al.
2006/0156508 A1* 7/2006 Khalil ..... A47L 5/24 15/353
2006/0156699 A1 7/2006 Kim
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0230726 A1 10/2006 Oh et al.
2006/0236663 A1 10/2006 Oh
2006/0278081 A1 12/2006 Han et al.
2007/0012002 A1 1/2007 Oh et al.
2007/0012003 A1 1/2007 Oh et al.
2007/0039120 A1 2/2007 Choi
2007/0067944 A1 3/2007 Kitamura et al.
2007/0079473 A1 4/2007 Min et al.
2007/0079584 A1 4/2007 Kim et al.
2007/0079585 A1 4/2007 Oh et al.
2007/0079587 A1 4/2007 Kim
2007/0084161 A1* 4/2007 Yoo ..... A47L 9/1625 55/345
2007/0095028 A1 5/2007 Kim et al.
2007/0095029 A1 5/2007 Min et al.
2007/0095030 A1 5/2007 Oh
2007/0226947 A1 10/2007 Kang
2007/0251048 A1 11/2007 Choi
2007/0271724 A1 11/2007 Hakan et al.
2007/0289085 A1 12/2007 Yoo
2007/0289089 A1 12/2007 Yacobi
2007/0289264 A1 12/2007 Oh
2008/0040883 A1* 2/2008 Beskow ..... A47L 5/225 15/329
2008/0047091 A1 2/2008 Nguyen
2008/0083085 A1 4/2008 Genn
2008/0134460 A1 6/2008 Conrad
2008/0134462 A1 6/2008 Jansen et al.
2008/0172821 A1 7/2008 Kang et al.
2008/0172995 A1 7/2008 Conrad
2008/0178416 A1 7/2008 Conrad
2008/0178420 A1 7/2008 Conrad
2008/0184893 A1 8/2008 Oh et al.
2008/0190080 A1 8/2008 Oh et al.
2008/0196195 A1 8/2008 Conrad
2008/0196196 A1 8/2008 Conrad
2008/0209666 A1 9/2008 Conrad
2008/0263813 A1* 10/2008 Han ..... A47L 5/225 15/334
2009/0031522 A1* 2/2009 Yoo ..... A47L 5/28 15/327.1
2009/0044371 A1 2/2009 Yoo et al.
2009/0113659 A1 5/2009 Jeon et al.
2009/0144929 A1 6/2009 Yoo
2009/0144930 A1* 6/2009 Yoo ..... A47L 5/225 15/328
2009/0144932 A1 6/2009 Yoo
2009/0241284 A1 10/2009 Mayes et al.
2009/0282639 A1 11/2009 Dyson et al.
2009/0307864 A1 12/2009 Dyson
2010/0005611 A1 1/2010 Hong et al.
2010/0043170 A1 2/2010 Ni
2010/0045215 A1 2/2010 Hawker et al.
2010/0071153 A1 3/2010 Genn
2010/0083459 A1 4/2010 Beskow et al.
2010/0095476 A1 4/2010 Kim et al.
2010/0162515 A1 7/2010 Stephens
2010/0175217 A1 7/2010 Conrad
2010/0175219 A1 7/2010 Soen et al.
2010/0229322 A1 9/2010 Conrad
2010/0229336 A1 9/2010 Conrad
2010/0229338 A1 9/2010 Conrad
2010/0242222 A1 9/2010 Conrad
2010/0293745 A1 11/2010 Coburn
2011/0023262 A1 2/2011 Conrad
2011/0219573 A1 9/2011 Conrad
2011/0289719 A1 12/2011 Han et al.
2011/0314629 A1 12/2011 Conrad
2012/0000030 A1 1/2012 Conrad
2012/0159734 A1 6/2012 Fujiwara
2012/0222239 A1 9/2012 Conrad
2012/0222245 A1 9/2012 Conrad
2012/0272472 A1 11/2012 Conrad
2013/0104335 A1 5/2013 Conrad
2014/0237768 A1 8/2014 Conrad
2016/0367094 A1 12/2016 Conrad

FOREIGN PATENT DOCUMENTS

CA 2675723 A1 6/2008
CA 2658005 A1 9/2010
CA 2658014 A1 9/2010
CA 2658381 A1 9/2010
CA 2658651 A1 9/2010
CA 2659212 A1 9/2010
CA 2674056 A1 9/2010
CA 2674761 A1 9/2010
CA 2678119 A1 9/2010
CA 2755305 A1 9/2010
CA 2755307 A1 9/2010
CA 2730689 A1 9/2011
CA 2574291 C 8/2013
CA 2677530 C 1/2014
CN 2524655 Y 12/2002
CN 2534954 Y 2/2003
CN 1626025 A 10/2005
CN 1765283 A 5/2006
CN 1806741 A 7/2006
CN 1895148 A 1/2007
CN 100998484 A 7/2007
CN 101015436 A 8/2007
CN 101061932 A 10/2007
CN 101095604 A 1/2008
CN 201101488 Y 8/2008
CN 101288572 A 10/2008
CN 101357051 A 2/2009
CN 101448447 A 6/2009
CN 101822506 A 9/2010
CN 201683850 U 12/2010
CN 101631494 B 4/2012
CN 202699035 U 1/2013
CN 203724037 U 7/2014
DE 3734355 C2 6/1989
DE 10110581 C2 11/2003
DE 69907201 T2 2/2004
DE 60012203 T2 8/2005
DE 60105004 T2 8/2005
DE 60201666 T2 6/2006
DE 202006017010 U1 2/2007
DE 60211663 T2 5/2007
DE 102007011457 A1 10/2007
DE 112006003479 T5 12/2008
DE 112007001314 T5 4/2009
DE 112010001135 T5 8/2012
DE 202012101457 U1 8/2012
DE 112011104642 T5 10/2013
DE 102012211246 A1 1/2014
EP 0489468 A1 6/1992
EP 0887040 A1 12/1998
EP 1674009 A2 6/2006

(56) References Cited

FOREIGN PATENT DOCUMENTS

| | | | |
|---|---|---|---|
| EP | 1771104 | B1 | 9/2008 |
| EP | 966912 | B1 | 3/2010 |
| EP | 2201881 | A1 | 6/2010 |
| EP | 2049000 | B1 | 6/2011 |
| EP | 2201875 | B1 | 4/2013 |
| EP | 1629758 | B1 | 10/2013 |
| FR | 2812531 | B1 | 11/2004 |
| GB | 2163703 | A | 3/1986 |
| GB | 2163703 | B | 1/1988 |
| GB | 2365324 | B | 7/2002 |
| GB | 2458243 | B | 4/2012 |
| JP | 2000140533 | A | 5/2000 |
| JP | 2004121722 | A | 4/2004 |
| JP | 2005040246 | A | 2/2005 |
| JP | 2005087508 | A | 4/2005 |
| JP | 2005211350 | A | 8/2005 |
| JP | 2009261501 | A | 11/2009 |
| JP | 2010081968 | A | 4/2010 |
| JP | 2010227287 | A | 10/2010 |
| KR | 1020040088978 | A | 10/2004 |
| KR | 20060112420 | A | 11/2006 |
| WO | 9619294 | A1 | 6/1996 |
| WO | 0078546 | A1 | 12/2000 |
| WO | 2004069021 | A1 | 8/2004 |
| WO | 2005089618 | A3 | 2/2006 |
| WO | 2006026414 | A3 | 8/2007 |
| WO | 2007104138 | A1 | 9/2007 |
| WO | 2008009883 | A1 | 1/2008 |
| WO | 2008009888 | A1 | 1/2008 |
| WO | 2008009890 | A1 | 1/2008 |
| WO | 2007084699 | A3 | 2/2008 |
| WO | 2008017802 | A1 | 2/2008 |
| WO | 2008070966 | A1 | 6/2008 |
| WO | 2008070980 | A1 | 6/2008 |
| WO | 2008135708 | A1 | 11/2008 |
| WO | 2009026709 | A1 | 3/2009 |
| WO | 2010102396 | A1 | 9/2010 |
| WO | 2010102410 | A1 | 9/2010 |
| WO | 2010102411 | A1 | 9/2010 |

OTHER PUBLICATIONS

English machine translation of CN1895148A, published on Jan. 17, 2007.
English machine translation of CN100998484, published on Jul. 18, 2007.
English machine translation of CN101015436, published on Aug. 15, 2007.
English machine translation of CN101061932, published on Oct. 31, 2007.
English machine translation of CN101095604, published on Jan. 2, 2008.
English machine translation of CN101288572, published on Oct. 22, 2008.
English machine translation of CN101448447, published on Jun. 3, 2009.
English machine translation of CN101822506, published on Sep. 8, 2010.
English machine translation of CN201683850, published on Dec. 29, 2010.
English machine translation of CN203724037, published on Jul. 23, 2014.
English machine translation of DE10110581, published on Nov. 13, 2003.
English machine translation of DE60012203, published on Aug. 18, 2005.
English machine translation of DE60105004, published on Aug. 16, 2005.
English machine translation of DE60201666, published on Jun. 1, 2006.
English machine translation of DE60211663, published on May 10, 2007.
English machine translation of DE69907201, published on Feb. 5, 2004.
English machine translation of DE102007011457, published on Oct. 25, 2007.
English machine translation of DE102012211246, published on Jan. 2, 2014.
English machine translation of DE112006003479, published on Dec. 18, 2008.
English machine translation of DE112007001314, published on Apr. 23, 2009.
English machine translation of DE112010001135, published on Aug. 2, 2012.
English machine translation of DE112011104642, published on Oct. 2, 2013.
English machine translation of DE202006017010, published on Feb. 8, 2007.
English machine translation of DE202012101457, published on Aug. 16, 2012.
English machine translation of JP2004121722, published on Apr. 22, 2004.
English machine translation of JP2005040246, published on Feb. 17, 2005.
English machine translation of JP2005211350, published on Aug. 11, 2005.
English machine translation of JP2009261501, published on Nov. 12, 2009.
English machine translation of JP2010081968, published on Apr. 15, 2010.
English machine translation of KR1020040088978, published on Oct. 20, 2004.
English machine translation of KR20060112420, published on Nov. 1, 2006.
English machine translation of CN101357051A published as of Feb. 4, 2009.
English machine translation of CN101631494B published as of Apr. 25, 2012.
English machine translation of CN1765283A published as of May 23, 2006.
English machine translation of CN1806741A published as of Jul. 26, 2006.
English machine translation of CN201101488Y published as of Aug. 20, 2008.
English machine translation of CN202699035U published as of Jan. 30, 2013.
English machine translation of CN2524655Y published as of Dec. 11, 2002.
English machine translation of CN2534954Y published as of Feb. 12, 2003.
English machine translation of DE3734355C2 published as Jun. 29, 1989.
English machine translation of FR2812531B1 published as Nov. 5, 2004.
English machine translation of JP2000140533A published as May 23, 2000.
English machine translation of JP2005087508A published as Apr. 7, 2005.
English machine translation of JP2005040246A published as Feb. 17, 2005.
English machine translation of JP2010227287A published as Oct. 14, 2010.
Makita Cordless Cleaner Handy Vac II, Model 4071, Instructions Manual, dated at least as early as Oct. 1993.

* cited by examiner

CONFIGURATION OF A SURFACE CLEANING APPARATUS

CROSS REFERENCE TO RELATED APPLICATIONS

This application is a continuation of U.S. patent application Ser. No. 14/470,342, filed Aug. 27, 2014 and entitled CONFIGURATION OF A SURFACE CLEANING APPARATUS, which is pending and which is a continuation of U.S. patent application Ser. No. 12/721,128, filed Mar. 10, 2010, entitled CONFIGURATION OF A SURFACE CLEANING APPARATUS, which claimed priority from Canadian Patent Application no. 2,658,005 and which is now U.S. Pat. No. 8,950,039, which itself is (a) a continuation-in-part of U.S. patent application Ser. No. 12/675,512 filed Feb. 26, 2010 entitled CYCLONIC SURFACE CLEANING APPARATUS WITH A SPACED APART IMPINGEMENT SURFACE, which is abandoned and which was a national phase entry of PCT/CA2008/001531 which claimed priority from CA2,599,303, and is (b) a continuation-in-part of U.S. patent application Ser. No. 12/675,540 filed on Feb. 26, 2010 entitled CYCLONIC SURFACE CLEANING APPARATUS WITH EXTERNALLY POSITIONED DIRT CHAMBER, now U.S. Pat. No. 9,027,201, and which was a national phase entry of PCT/CA2008/001530 which claimed priority from CA2,599,303; and, is (c) a continuation-in-part of U.S. patent application Ser. No. 12/675,636 filed Feb. 26, 2010 entitled CYCLONIC SURFACE CLEANING APPARATUS WITH SEQUENTIAL FILTRATION MEMBERS which is abandoned and which was a national phase entry of PCT/CA2008/001519 which claimed priority from CA2,599,303;

FIELD

The specification relates to surface cleaning apparatus such as vacuum cleaners. In a preferred embodiment, the specification relates to cyclonic hand vacuum cleaners.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device. and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims According to one broad aspect, a surface cleaning apparatus and, preferably a cyclonic hand vacuum cleaner and/or a surface cleaning unit that is removably mounted to an upright support structure that is pivotally mounted to a cleaning head is provided wherein at least part, and preferably a substantial portion, of the air flow path between components of the surface cleaning apparatus is linear. Accordingly, one or more components of the vacuum cleaner may be arranged such that the air outlet of an upstream component faces the air inlet of a downstream component. In a preferred embodiment, the outlet from a cyclone is oriented such that the air may travel generally linearly to the inlet of a suction motor. This may be achieved by orienting the axis of a cyclone such that the cyclone axis is generally parallel to the axis of the suction motor. If the hand vacuum cleaner has more than one cyclonic stage, then the outlet of the last pre-motor cyclone or cyclones is preferably oriented such that the air may travel generally linearly to the inlet of a suction motor. It will be appreciated that one or more pre-motor filters may be positioned between the cyclone outlet and the suction motor inlet. Preferably, the air flow through the pre-motor filter or filters is generally linear. It will be appreciated that the air outlet of other components (e.g., a cyclone, filter or suction motor) may also be oriented such that the air may travel generally linearly to the inlet of the next downstream component (e.g., a cyclone, filter or suction motor).

An advantage of this design is that the backpressure in the airflow path through the hand vacuum cleaner may be reduced. Accordingly, the airflow rate through the hand vacuum cleaner may be increased without increasing the size (and weight) of the suction motor. Alternately, or in addition, a smaller motor may be used with decreasing the airflow rate through the hand vacuum cleaner.

Accordingly, the hand vacuum cleaner may comprise a front end, a rear end andn air flow passage extending from a dirty air inlet to a clean air outlet. A first cyclone unit is positioned in the air flow passage. The first cyclone unit may comprise at least one cyclone comprising a cyclone inlet and a cyclone outlet, and at least one dirt collection chamber. A suction motor is positioned in the air flow passage preferably downstream from the first cyclone unit. The air flow passage may include a generally linear air flow path from the cyclone outlet to the suction motor.

In some examples, the vacuum cleaner further comprises a pre-motor filter, wherein the first cyclone unit, the pre-motor filter and the suction motor are arranged linearly. Accordingly, the inlets and the outlets may face each other so that the air travels generally in a straight line between the components. It will be appreciated that the components may be arranged along a straight line.

In some examples, the at least one cyclone has a cyclone axis extending longitudinally through the at least one cyclone, the hand vacuum cleaner has an axis extending from the front end to the rear end, and the cyclone axis is generally parallel to the axis of the hand vacuum cleaner. The cyclone axis may be parallel to an axis extending through the suction motor (e.g., co axial or parallel to the shaft on which a suction fan rotates.

In some examples, the at least one cyclone has a cyclone axis extending longitudinally through the at least one cyclone, the suction motor has a motor axis extending generally parallel to the axis of rotation of a suction fan and the cyclone axis is generally parallel to the motor axis.

In some examples, the suction motor is positioned rearward of the first cyclone unit.

In some examples, the first cyclone unit is positioned at the front end of the hand vacuum cleaner.

In some examples, the dirt collection chamber has an openable door provided at a front end of the first cyclone unit.

In some examples, the at least one cyclone has a cyclone front end, and a cyclone rear end, and the cyclone air inlet and the cyclone air outlet are at the same end of the at least one cyclone. In some examples, the cyclone air inlet and the cyclone air outlet are at the cyclone rear end. The cyclone may have a dirt outlet and the dirt out is preferably positioned at an end opposed to the end having the cyclone air inlet. Preferably, the cyclone dirt outlet is at the cyclone front end.

In some examples, the cyclone front end is proximate the front end of the hand vacuum cleaner, the cyclone front end has a dirt outlet, and a separation plate is mounted in facing relation to the dirt outlet.

In some examples, the dirt collection chamber has an openable door provided at the cyclone front end and the separation plate is mounted to the door. The door may alternately or in addition be removable.

In some examples, the at least one dirt collection chamber is openable when mounted to the hand vacuum cleaner.

In some examples, the vacuum cleaner further comprises a suction motor housing. The suction motor is positioned in the suction motor housing and the first cyclone unit is removably mounted to the suction motor housing.

In some examples, the vacuum cleaner further comprises a pre-motor filter positioned facing the cyclone air outlet and having a pre-motor filter air inlet and a pre-motor filter air outlet. The suction motor has a motor axis extending generally parallel to the axis of rotation of a suction fan and the pre-motor filter air inlet and the pre-motor air outlet each define a plane that is generally transverse to the motor axis.

In some examples, the vacuum cleaner further comprises a post motor filter having a post motor filter air inlet and a post motor filter air outlet, the suction motor has a motor axis extending generally parallel to the axis of rotation of a suction fan, and the post motor filter air inlet and the post motor air outlet are generally transverse to the motor axis.

In some examples, the vacuum cleaner further comprises a pre-motor filter having a pre-motor filter air inlet and a pre-motor filter air outlet and a post motor filter having a post motor filter air inlet and a post motor filter air outlet, and some, and preferably all, of the pre-motor filter air inlet, the pre-motor air outlet, the post motor filter air inlet and the post motor air outlet are aligned.

In some examples, the vacuum cleaner further comprises a post motor filter positioned downstream from the suction motor and comprising an air outlet at the rear end of the hand vacuum cleaner.

In some examples, the vacuum cleaner further comprises the first cyclone unit comprises a single cyclone and a single dirt collection chamber. In other examples, the vacuum cleaner further comprises a second cyclone unit downstream from the first cyclone unit. In such examples, the second cyclone unit may have a second cyclone air inlet having a direction of flow and a second cyclone air outlet having a direction of flow and the direction of flow through the second cyclone air inlet and/or the second cyclone air outlet may be in the same direction as the direction of air flow through the cyclone outlet.

According to another broad aspect, a surface cleaning apparatus is provided. The surface cleaning apparatus comprises an air flow passage extending from a dirty air inlet to a clean air outlet. The surface cleaning apparatus further comprises a floor cleaning unit comprising a surface cleaning head and a handle drivingly connected thereto. A surface cleaning unit is removably mounted to the floor cleaning unit. The surface cleaning unit comprises a first cyclone unit positioned in the air flow passage. The first cyclone unit comprises at least one cyclone comprising a cyclone inlet and a cyclone outlet and at least one dirt collection chamber. A suction motor is positioned in the air flow passage downstream from the first cyclone unit. The air flow passage includes a generally linear air flow path from the cyclone outlet to the suction motor.

In some examples, the surface cleaning unit is operable when removed from the floor cleaning unit.

In some examples, the air flow passage comprises a portion extending from the surface cleaning head to the surface cleaning unit and the portion comprises a flexible conduit.

In some examples, the first cyclone unit is positioned above the suction motor when the surface cleaning unit is mounted to the floor cleaning unit.

In some examples, the first cyclone unit has a portion that is openable or removable and the portion is located at an upper end of the first cyclone unit.

In some examples, the surface cleaning unit is removably mounted to the handle.

According to another broad aspect, an upright surface cleaning apparatus is provided. The upright surface cleaning apparatus comprises an air flow passage extending from a dirty air inlet to a clean air outlet. A floor cleaning unit is provided which comprises a surface cleaning head and a handle drivingly connected thereto. A first cyclone unit is supported by the handle and is in the air flow passage. The first cyclone unit comprises at least one cyclone comprising a cyclone inlet and a cyclone outlet and at least one dirt collection chamber. A suction motor is supported by the handle below the first cyclone unit.

In some examples, the cyclone unit is mounted to the handle.

In some examples, the air flow passage includes a generally linear air flow path from the cyclone outlet to the suction motor.

It will be appreciated that the vacuum cleaner may incorporate one or more of the features of each of these examples.

DRAWINGS

In the detailed description, reference will be made to the following drawings, in which.

DESCRIPTION OF VARIOUS EXAMPLES

Figure 1:
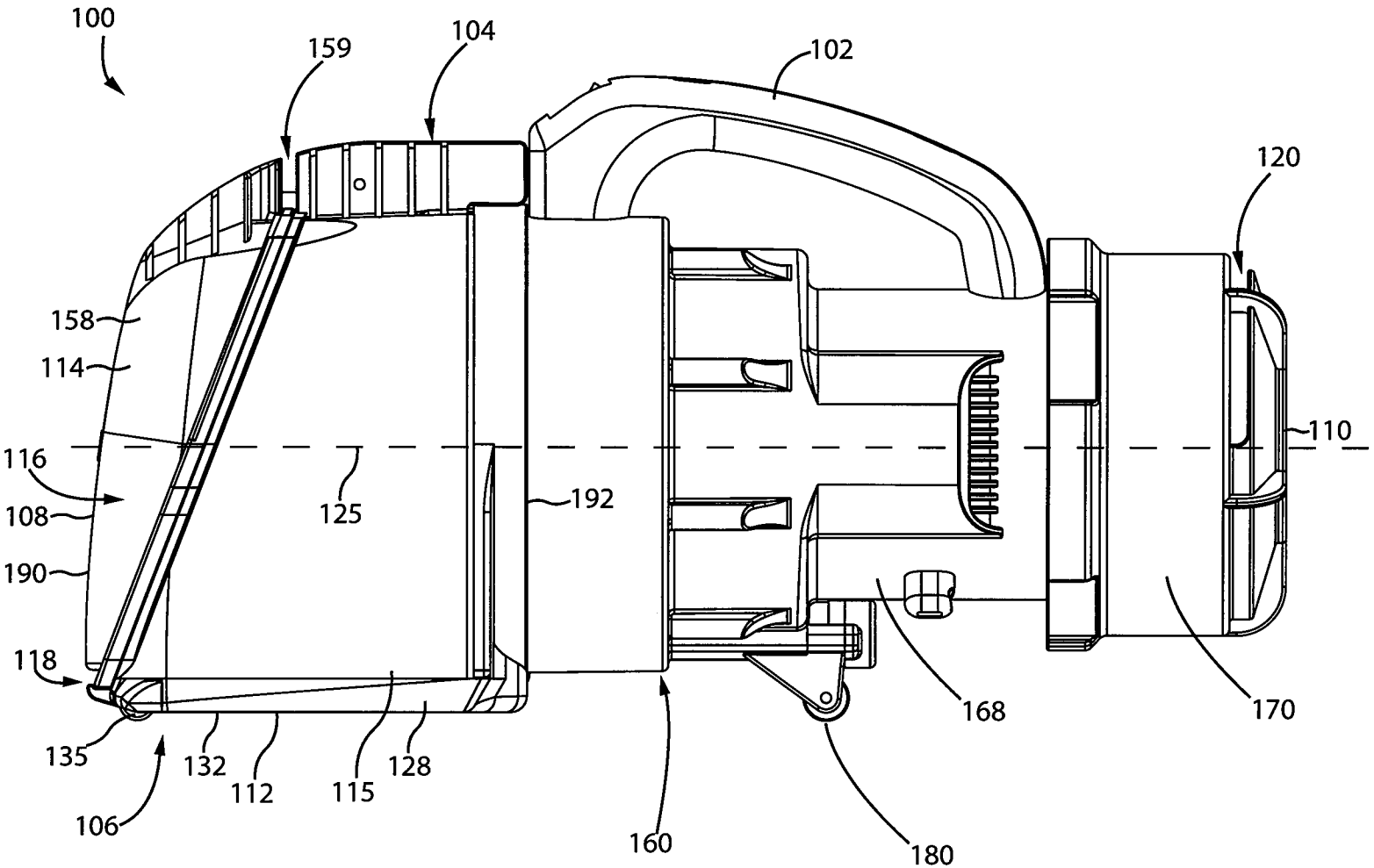
FIG. 1 is a side plan view of an example of a surface cleaning unit.
Figure 2:
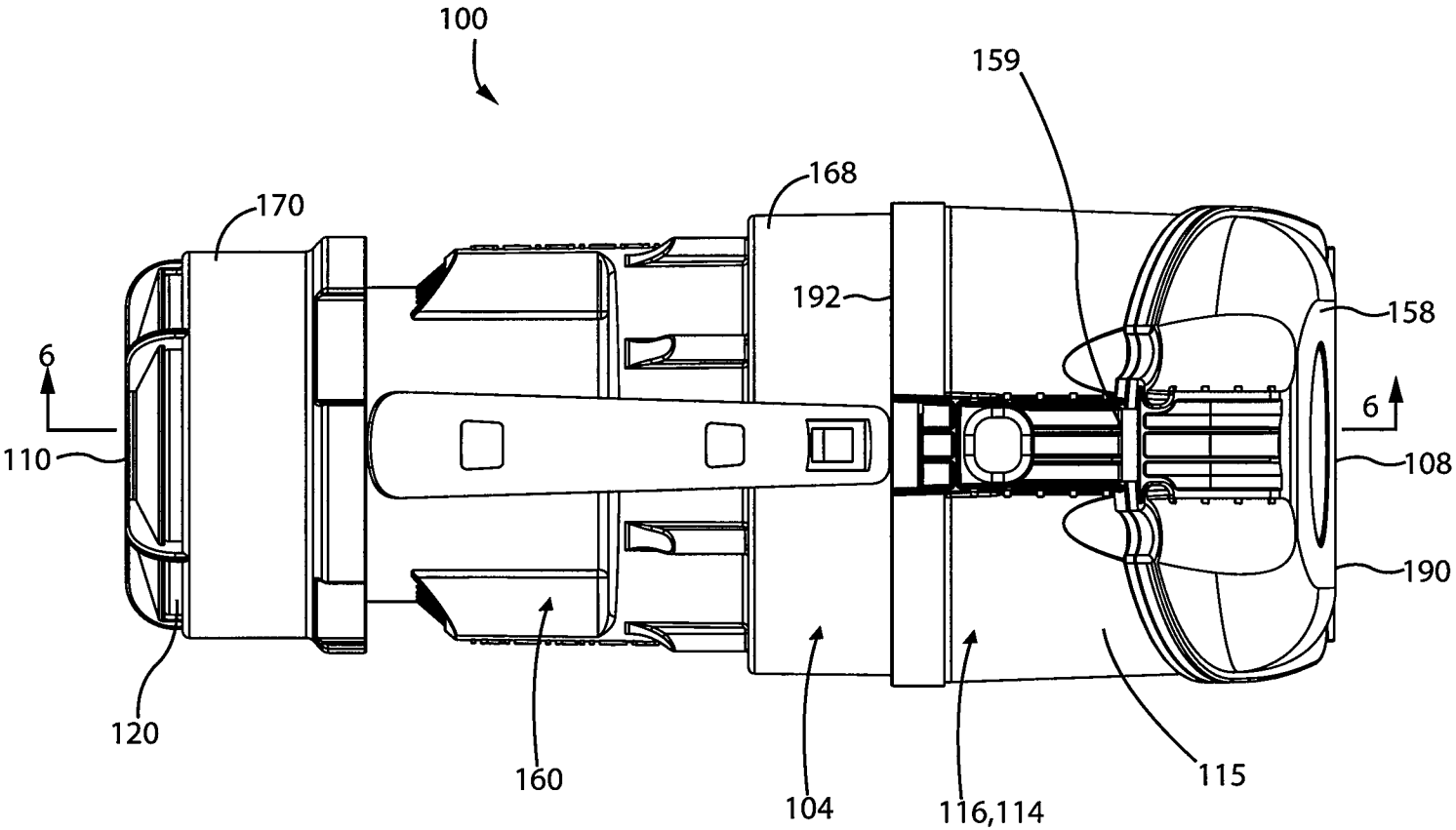
FIG. 2 is a top plan view of the surface cleaning unit of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

In the drawings attached hereto, the hand vacuum cleaner is exemplified as comprising one or two cyclonic stages. It will be appreciated that the vacuum cleaner 100 may be of various configurations (e.g., different positioning of the cyclonic stages and the suction motor and differing cyclonic stages that may comprise one or more cyclones and one or more filters).

Referring to FIGS. 1 to 7, a first example of a surface cleaning unit 100 is shown. In the embodiment shown, the surface cleaning unit 100 (also referred to herein as vacuum cleaner 100 or cleaner 100) is usable as a vacuum cleaner 100, and more particularly a hand vacuum cleaner 100. The vacuum cleaner 100 is movable along a surface to be cleaned by gripping and maneuvering handle 102. The vacuum cleaner includes an upper portion 104, a lower portion 106, a front end 108, and a rear end 110. A longitudinal axis 125 of the vacuum cleaner 100 extends between the front end 108 and the rear end 110. In the example shown, handle 102 is provided at the upper portion 104. In alternate examples, handle 102 may be provided elsewhere on the vacuum cleaner 100, for example at the rear 110 and may be of any design.

In the example shown, the vacuum cleaner 100 comprises a nozzle 112 and a cyclone unit 114, which together preferably form a surface cleaning head 116 of the vacuum cleaner 100. In the example shown, the surface cleaning head 116 is preferably provided at the front end 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Cyclone unit 114 is provided in the airflow passage, downstream of the dirty air inlet 118. Cyclone unit 116 has a front end 190, and a rear end 192. In the example shown, the cyclone unit 114 is a one piece assembly comprising one cyclone 122, and one dirt collection chamber 124, which are integrally formed. In alternate examples, as will be described hereinbelow with respect to FIG. 8, the cyclone unit 110 may include more than one cyclonic stage, wherein each cyclonic stage comprises one or more cyclones and one or more dirt chambers. Accordingly, the cyclones may be arranged in parallel and/or in sequence. Further, in alternate examples, the cyclone 122 and dirt collection chamber 124 may be separately formed.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. However, it will be appreciated that nozzle 112 may be connected to the cyclone unit or dirt collection chamber at alternate locations.

Figure 6:
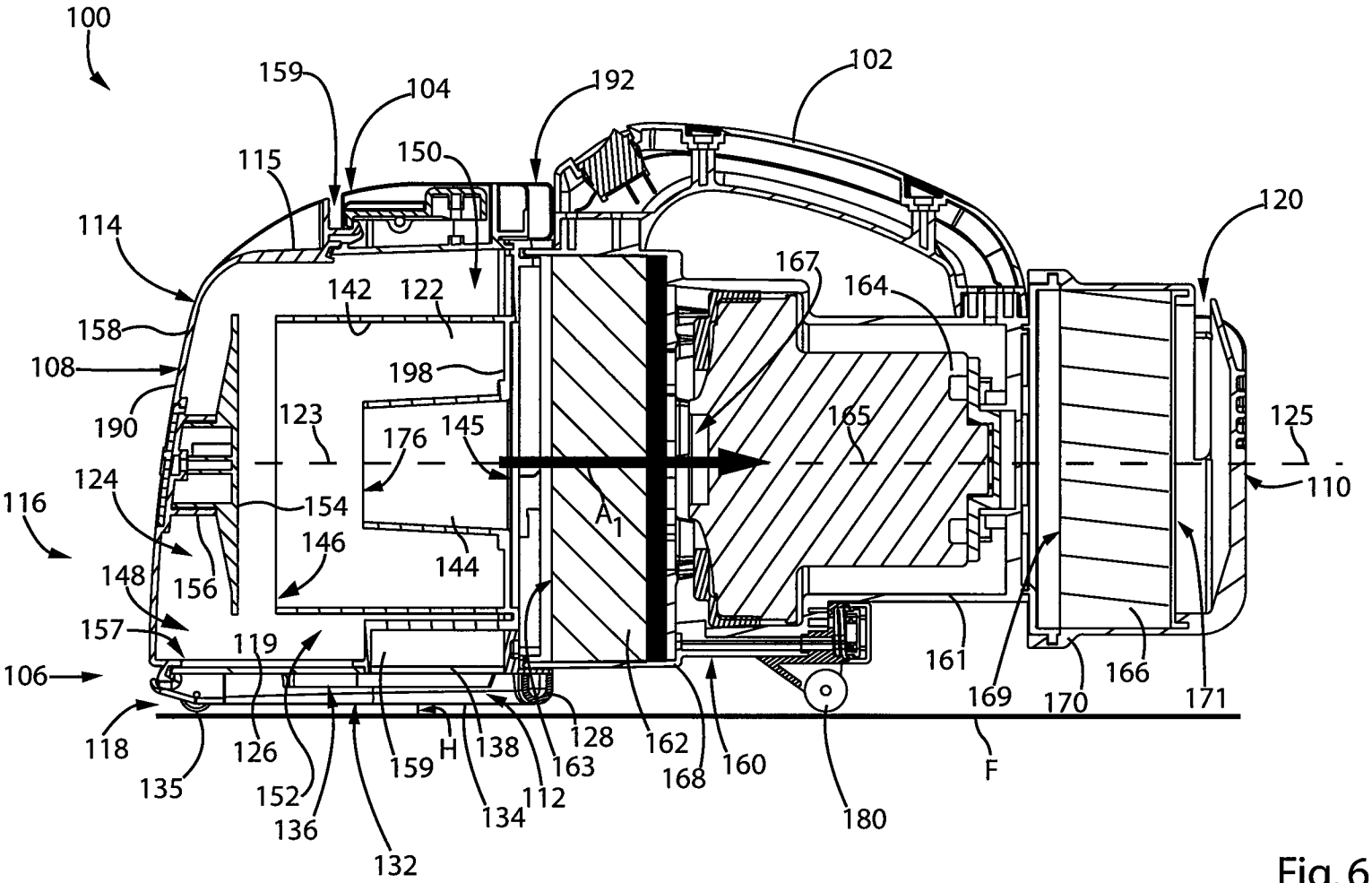
FIG. 6 is a cross section taken along line 6-6 in FIG. 2.
Figure 7:
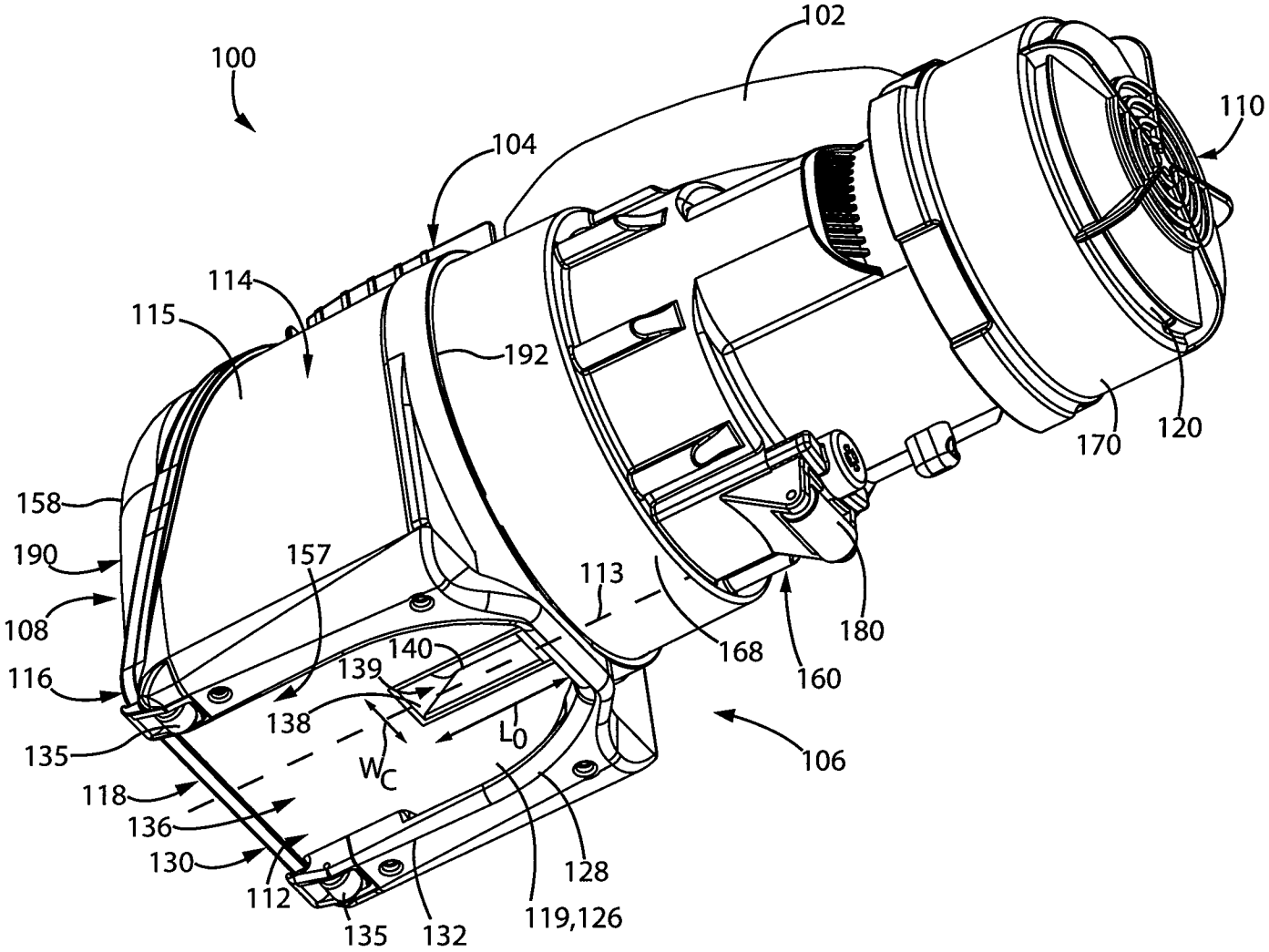
FIG. 7 is a bottom perspective view of the surface cleaning unit of FIG. 1.

Preferably, as exemplified, nozzle 112 may be on lower surface 157 of cyclone unit 114 and may share a wall with the cyclone unit 114. For example, in a particularly preferred design, the upper wall 126 of the nozzle 112 may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
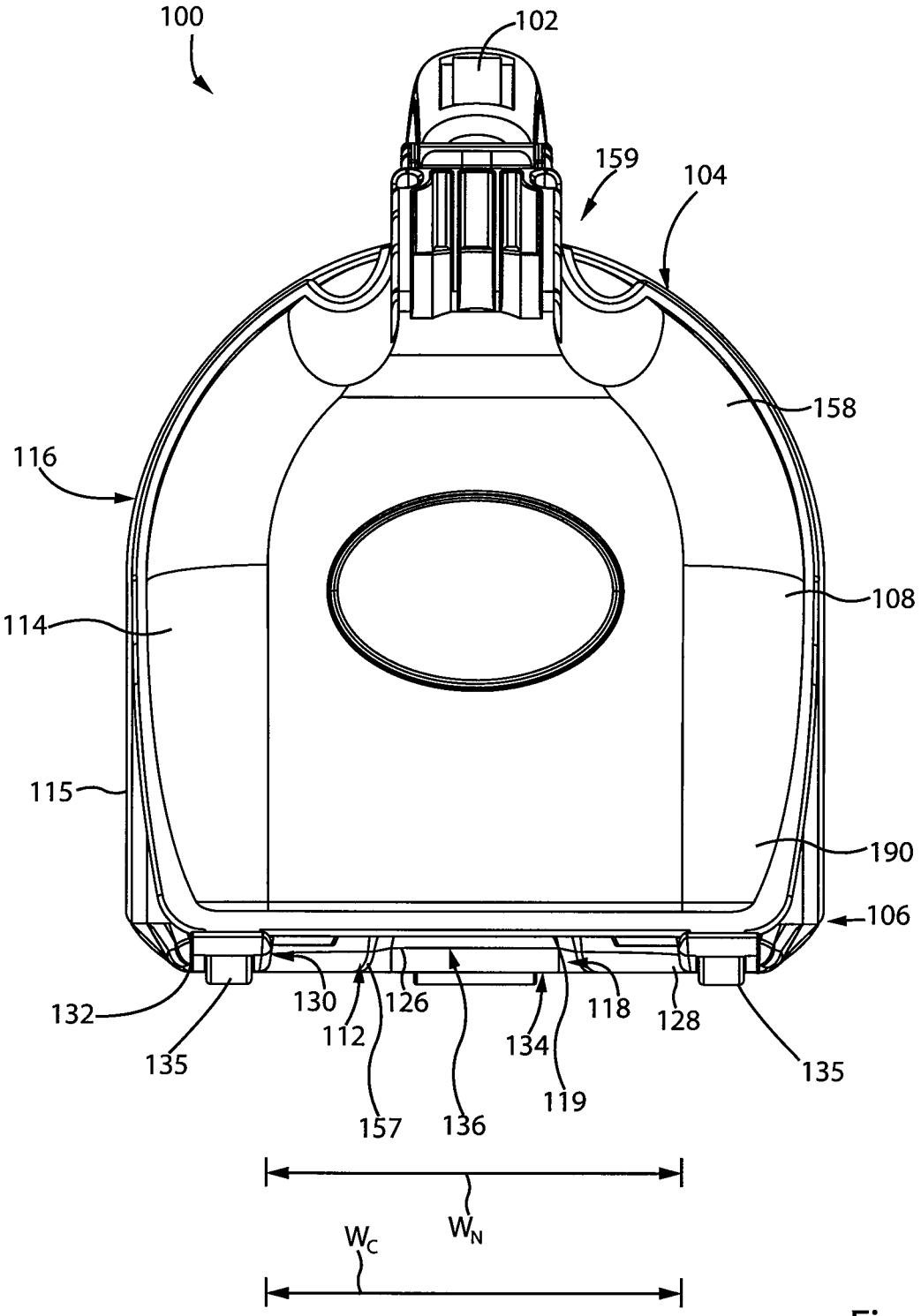
FIG. 3 is a front plan view of the surface cleaning unit of FIG. 1.
Figure 4:
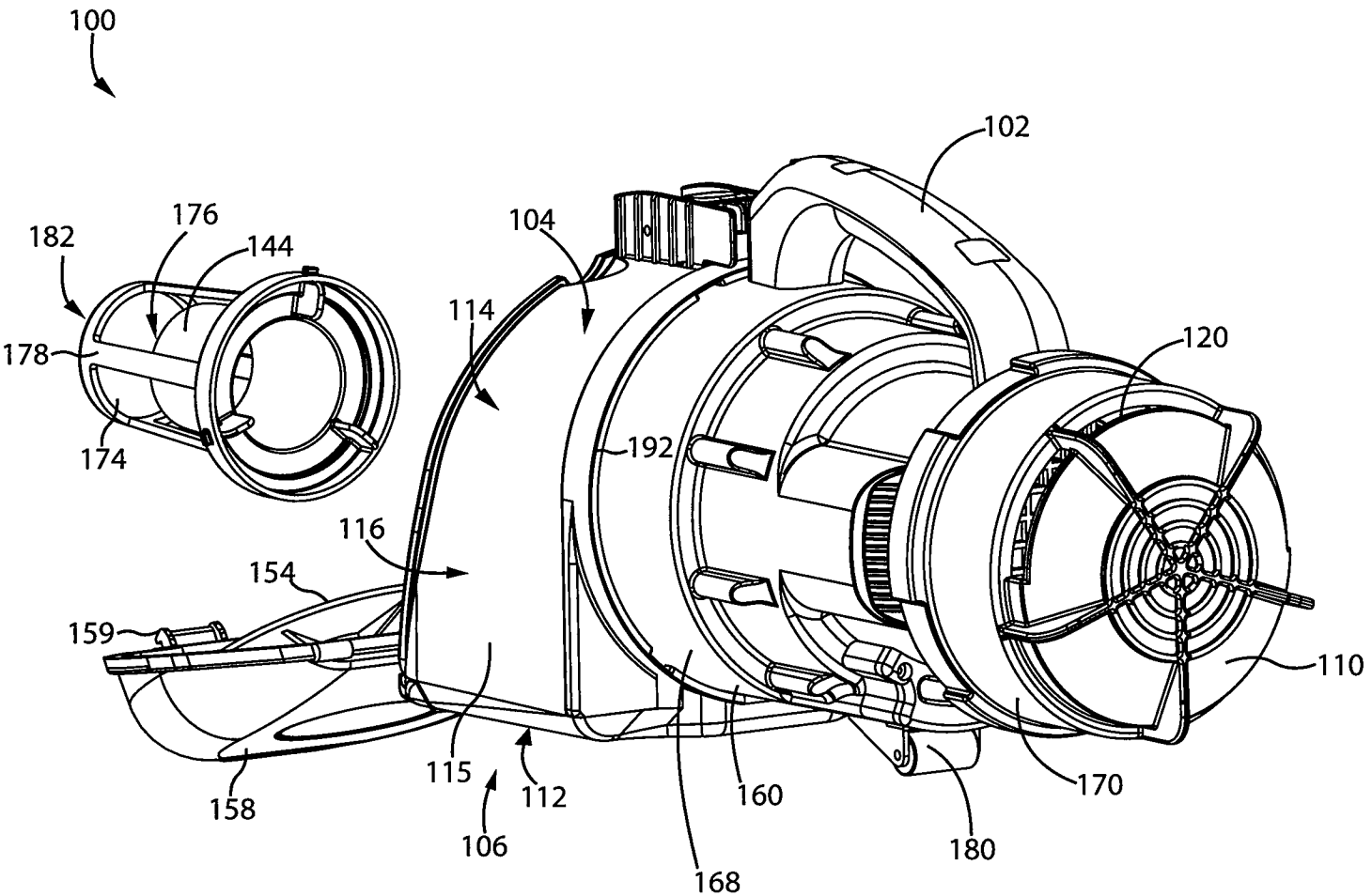
FIG. 4 is a partially exploded rear perspective view of the surface cleaning unit of FIG. 1.
Figure 5:
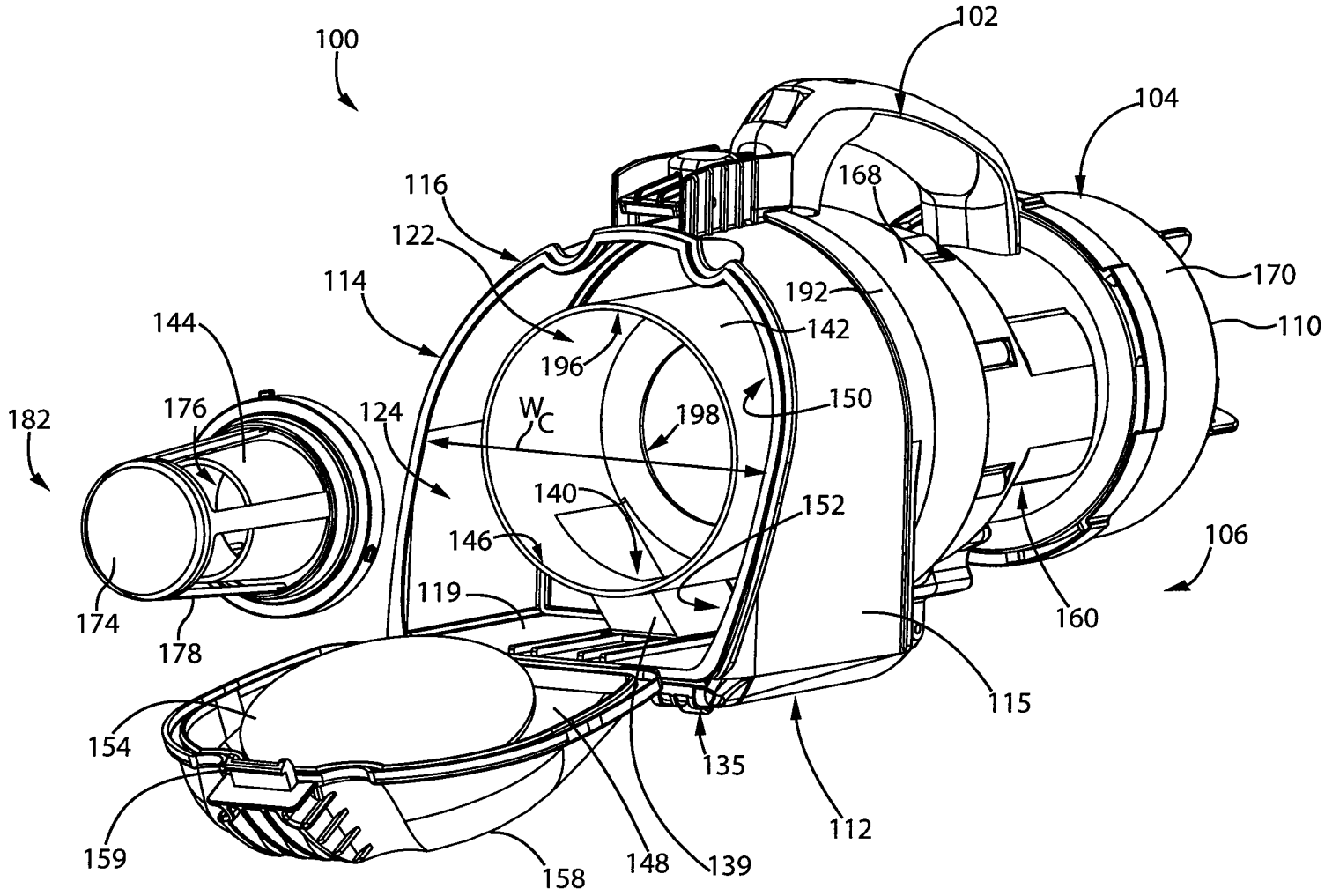
FIG. 5 is a partially exploded front perspective view of the surface cleaning unit of FIG. 1.

As shown in FIGS. 3 and 5, nozzle 112 has a width $W_N$, and cyclone unit 114 has a width $W_C$. In the example shown, $W_N$, and $W_C$ are about the same. An advantage of this design is that the nozzle 112 may have a cleaning path that is essentially as wide as the hand vacuum itself.

Preferably, nozzle 112 comprises an airflow chamber 136 wherein at least a portion, and preferably a majority, of the lower surface 134 of the chamber is open. In an alternate design as exemplified by FIG. 8, nozzle 812 comprises a lower wall 837, which closes lower end 834. Accordingly, nozzle 112 may be of various designs and may be an open sided passage or a closed passage. In either embodiment, it will be appreciated that nozzle 112 may be mounted or provided on cyclone unit 114 and as exemplified on a lower portion of the dirt collection chamber so as to be removable with the dirt collection chamber An open sided design is exemplified in FIG. 7A wherein nozzle 112 comprises an upper nozzle wall 126. In the example shown, the upper nozzle wall 126 comprises a portion 119 of a wall 115 of the cyclone unit.

Preferably, one or more depending walls 128 extend downwardly from the upper nozzle wall 126. The depending wall is preferably generally U-shaped. In one embodiment, a depending wall 128 is provided rearward of opening 138. In other embodiments, depending walls may alternately or in addition be provided on the lateral sides of opening 138. It is preferred that the depending walls may be continuous to define a single wall as shown, or may be discontinuous. The depending walls may be provided on each lateral side of opening 138 and rearward thereof. Further, depending walls 128 may extend a substantial distance to the front end 108 and, preferably, essentially all the way to front end 108. The depending wall 128 may be continuous to define a single wall as shown, or may be discontinuous. The depending wall is preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 inches to 0.175 inches, more preferably from 0.04 to 0.08 inches.

The height of the depending wall 128 (between upper nozzle wall 126 and lower end 132) may vary. In some examples, the depending wall may have a height of between about 0.05 and about 0.875 inches, preferably between about 0.125 and about 0.6 inches and more preferably between about 0.2 and about 0.4 inches. The height of depending wall 128 may vary but is preferably constant.

As exemplified, the open end of the U-shape defines an open side 130 of the nozzle 114, and forms the dirty air inlet 118 of the cleaner 100. In the example shown, the open side 130 is provided at the front of the nozzle 114. In use, when optional wheels 135 are in contact with a surface, the open side 130 sits above and is adjacent a surface to be cleaned (e.g. floor F). As mentioned hereinabove, preferably, lower end 132 of depending walls 128 is spaced above floor F. Accordingly, some air may enter nozzle 114 by passing underneath depending wall 132. In such a case, the primary air entry to nozzle 114 is via open side 130 so that dirty air inlet 118 is the primary air inlet, with a secondary air inlet being under depending wall 128.

In the example shown, the lower end 132 of the depending wall 128 defines an open lower end 134 of the nozzle 114. The open lower end 134 preferably extends to the front 108 of the cleaner 100, and merges with the open side 130. In use, the exemplified nozzle 112 has an open lower end 134 that faces a surface to be cleaned.

In the example shown, a plurality of wheels 135 are mounted to the depending wall 128, and extend lower than the lower end 132 of the depending wall 128. Accordingly, in use, when wheels 135 are in contact with a surface, the lower end 132 of the depending wall 128 is spaced from the surface to be cleaned, and the space between the lower end of the depending wall 128 and the surface to be cleaned form the secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 are provided. Preferably, the wheels are located adjacent front 108. Optionally, one or more rear wheels 180 may be provided. In an alternate embodiment, no wheels may be provided.

The upper nozzle wall 126, depending wall 128, and open lower end 134 of the nozzle 112 define open sided airflow chamber 136 of the nozzle. In use, when wheels 135 are in contact with a horizontal surface, the nozzle 112 and the airflow chamber 136 preferably extend generally horizontally, and preferably linearly along a nozzle axis 113 (see FIG. 7).

An opening 138 maybe provided in the upper nozzle wall 126, and is in communication with the airflow chamber 136. Opening 138 may be of any size and configuration and at various locations in upper nozzle wall 126. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is in communication with a cyclone inlet 140 of cyclone 122.

As exemplified in FIGS. 1-7, a single cyclone is used. As exemplified therein, the direction of air exiting the outlet of cyclone 122 is the same as the direction of airflow immediately upstream of the suction motor 164. Further, while an optional pre-filter 162 is positioned between the cyclone air outlet 145 and the suction motor 162, the front and rear face of the pre-motor filter are each preferably transverse to the direction of airflow leaving the cyclone outlet 145. Further, the direction of airflow through the pre-motor filter 162 is preferably in the same direction as the air leaving the cyclone outlet 145. Accordingly, in this preferred embodiment, while the air may spread out or converge as it travels through the pre-motor filter 162, some and preferably all of the air continues to generally travel in the same direction, namely rearwardly.

It will be appreciated that cyclone 122 may of any configuration and orientation. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and/or preferably parallel to the cleaner axis 125. Axis 123 preferably extends generally horizontally when cleaner 100 is in use and wheels 135 are seated on a surface. Cyclone 122 has a front end 196, and a rear end 198. In the example shown, the front end 196 of the cyclone 122 is proximate the front end 108 of the vacuum cleaner 100.

Preferably, the cyclone air inlet 140 and the cyclone air outlet 145 are at the same end of the cyclone 122 and the dirt outlet 146 is at an opposed end. The cyclone air outlet 145 may be covered by a screen or shroud or filter as is known in the art. As exemplified, the cyclone air inlet 140 is defined by an aperture in the chamber wall 142. The cyclone inlet 140 is preferably at the rear end 198 of the cyclone 122. As can be seen in FIG. 5, the inlet passage 139 is configured such that air enters the cyclone 122 in a tangential flow path, e.g., passage 139 may be arcuate. The air travels in a cyclonic path in the cyclone 122, and dirt in the air is separated from the air. The air exits the cyclone via an outlet passage 144, through outlet 145. Outlet 145 is preferably at the rear end 198 of the cyclone. Accordingly, inlet 140 and outlet 145 are at the same end of the cyclone.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt collection chamber 124. Dirt outlet is preferably at the front 196 of the cyclone 122, and further, is at the front end 108 of the cleaner 100. The dirt collection chamber 124 may be internal or external to the cyclone chamber. Preferably, as exemplified, the dirt collection chamber is external. The dirt collection chamber 124 may be in communication with the cyclone chamber 122 by any means known in the art. Accordingly, one or more dirt outlets may be provided. Preferably, the dirt outlet is at the end opposed to the air inlet and, preferably, the dirt outlet is at the front end 108.

In the example shown, dirt collection chamber 124 preferably comprises two portions. A first portion 148 is provided immediately adjacent the dirt outlet 146, and is at the front end 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt collection chamber 124, and may be mounted in facing relation to the dirt outlet 146. The separation plate 154 aids in preventing dirt in dirt chamber 124 from re-entering cyclone 122. Preferably, plate 154 is spaced from dirt outlet 146. Plate 154 may be mounted by any means to any component in cyclone unit 114. As exemplified, the separation plate may be mounted on an arm 156, which extends from a front wall 158 at the front end 190 of the cyclone unit 114.

Cyclone unit 114 may be emptied by any means known in the art. For example, one of the ends of the cyclone unit 114 may be openable and/or removable. The end may open cyclone chamber as well as the dirt collection chamber. As exemplified in FIGS. 4 and 5, front wall 158 is pivotally mounted to the cyclone unit wall 115, and provides an openable door of the cyclone unit 114. Accordingly, cyclone unit 114 may be opened, and dirt chamber 124 may be emptied. The dirt collection chamber 124 is preferably openable both when the dirt collection chamber 124 is mounted to the hand vacuum cleaner, or when it is optionally removed, as will be described hereinbelow. If a plate 124 is provided on the front wall, then when front wall 158 is pivoted away from the remainder of the cyclone unit 114, separation plate 154 and arm 156 also pivot away from the remainder of the cyclone unit. A latch 159 or other securing member or members may be provided, which secure front wall 158 to wall 115. In alternate examples, front wall 158 may be removable from cyclone unit wall 115, or the rear wall 179 of the cyclone unit 114 may be openable or removable. In an alternate embodiment, only the dirt chamber may be removable.

The rear portion of the dirt collection chamber 124 may be closed by wall 179.

The clean air exiting cyclone 122 passes through outlet 145 of outlet passage 144, exits surface cleaning head 116, and passes into the cleaner body 160. In the example shown, the cleaner body 160 is downstream of the surface cleaning head 116, and positioned rearward of the surface cleaning head 116. The cleaner body comprises a suction motor housing 168, which houses an optional pre-motor filter 162, a suction motor 164 and may house an optional post-motor filter 166. As can be seen in FIG. 6, the air flow passage includes a generally linear airflow path (indicated by arrow A1) between outlet 145 and suction motor 164. That is, the air flow passage does not comprise significant bends between outlet 145 and suction motor 164.

In the example shown, suction motor housing 168 further houses a pre-motor filter 162. One or more filters may be used. Pre-motor filter 162 is provided in the airflow path preferably adjacent and downstream of the outlet passage 144, and preferably facing the outlet 145. Pre-motor filter 162 has an inlet 163, and an outlet 167. Pre-motor filter 162 serves to remove remaining particulate matter from air exiting the cyclone 122, and may be any type of filter, such as a foam filter. As can be seen in FIG. 6, the cyclone unit 114, the pre motor filter 162, and the suction motor 164 are arranged linearly.

Suction motor 164 is provided in the airflow path adjacent and downstream of the pre-motor filter 162. The suction motor 164 may be any type of suction motor. The suction motor draws air into the dirty air inlet 118 of the cleaner 100, through the airflow path past the suction motor 164, and out of the clean air outlet 120. The suction motor 164 has a motor axis 165, which is generally parallel to the axis of rotation of a suction fan (not shown) of the suction motor. In the example shown, the motor axis 165 and the cyclone axis 123 extend in the same direction and are generally parallel. Further, in the example shown, the inlet 163 and the outlet 167 of the pre-motor 162 filter are generally transverse to the motor axis 165. That is, the inlet 163 and the outlet 167 of the pre-motor filter 162 are defined in planes that are transverse to the motor axis 165.

The cleaner body 160 preferably further comprises a post-motor filter housing 170. A post motor filter 166 is provided in the post-motor filter housing 170. The post motor filter 166 is provided in the airflow path downstream of, and preferably adjacent, the suction motor 164. The post-motor filter comprises an inlet 169 and an outlet 171. Outlet 171 is at the rear 110 of cleaner 100. In the example shown, the plane of the inlet 169 and, preferably in addition, the plane of the outlet 171 are generally transverse to the motor axis 165. Accordingly, the pre-motor filter air inlet 163, the pre-motor filter air outlet 167, the post motor filter air inlet 169 and optionally the post motor filter air outlet 171 are aligned. Post motor filter 166 serves to remove remaining particulate mater from air exiting the cleaner 100. Post-motor filter 166 may be any type of filter, such as a HEPA filter.

Clean air outlet 120 is provided downstream of post-motor filter 166. Clean air outlet 120 may comprise a plurality of apertures formed in housing 170.

In the example shown, cleaner body 160 is preferably removably mounted to surface cleaning head 116, such as by a bayounet mount, a screw mount or hand manipulateable mechanical fasteners. For example, cleaner body 160 may be entirely removable from surface cleaning head 116, or pivotally mounted to surface cleaning head 116. Accordingly, cleaner body 160 and surface cleaning head 116 may be separated in order to provide access to the interior of cleaner body 160 or surface cleaning head 116. This may allow pre-motor filter 162 to be cleaned, changed, or serviced, or motor 164 to be cleaned, changed or serviced. Alternately, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively.

One or more additional wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Figure 8:
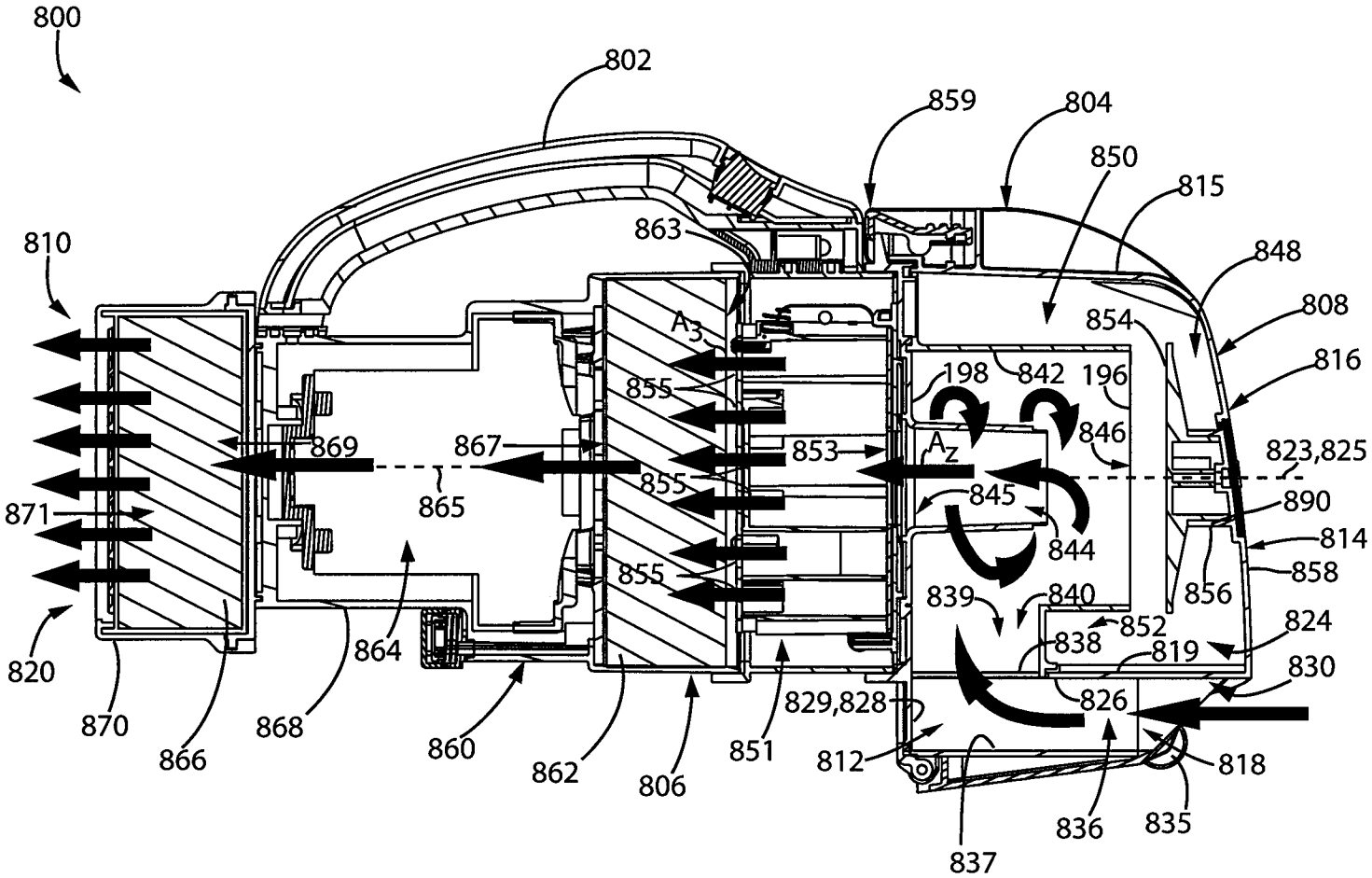
FIG. 8 is a cross section showing an alternate example of a surface cleaning unit.

Referring now to FIG. 8, in which like numerals refer to like features, with the first digit incremented to 8 to refer to the figure number, an alternate example of a hand vacuum cleaner 800 is shown. In this example, front wall 858 is not pivotally mounted to wall 815. Rather, wall surface cleaning head 816 is pivotally mounted to body 860.

Cleaner 800 further comprises a second optional cyclone unit 851 downstream of the first cyclone unit 814, between first cyclone unit 814 and pre-motor filter 862. In the example shown, the second cyclone unit 851 comprises a plurality of cyclones in parallel. Each of the plurality of cyclones is parallel to the first cyclone axis 823. Second cyclone unit 851 has an air inlet 853 and a plurality of air outlets 855. The direction of flow into the inlet 853 (indicated by arrow A2), and out of the outlets 855 (indicated by arrows A3) is the same as the direction of flow through the outlet 845 of the first cyclone unit 814 (also indicated by arrow A2).

Figure 9:
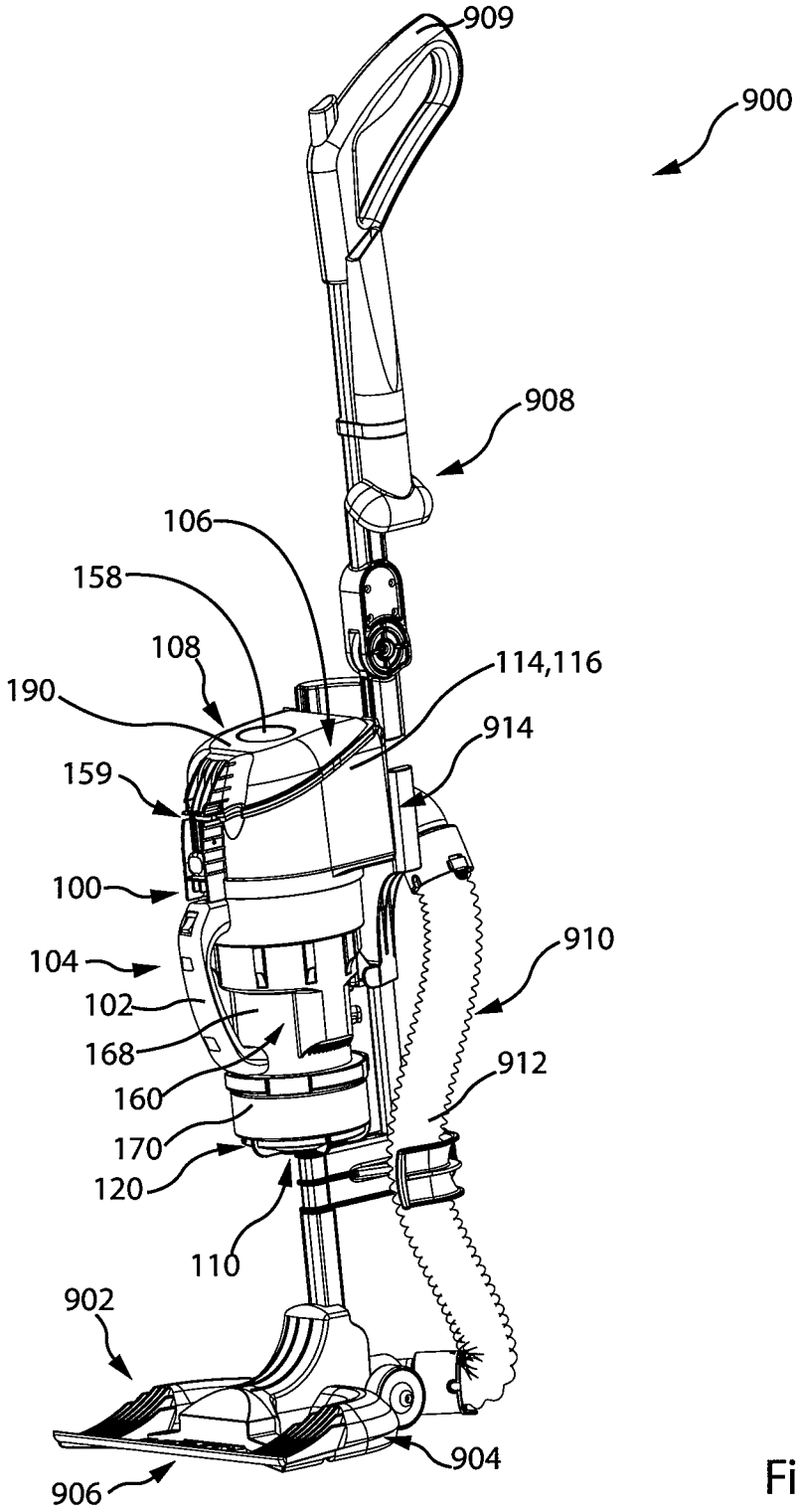
FIG. 9 is a perspective illustration of the surface cleaning unit of FIG. 1 mounted in a surface cleaning apparatus.
Figure 10:
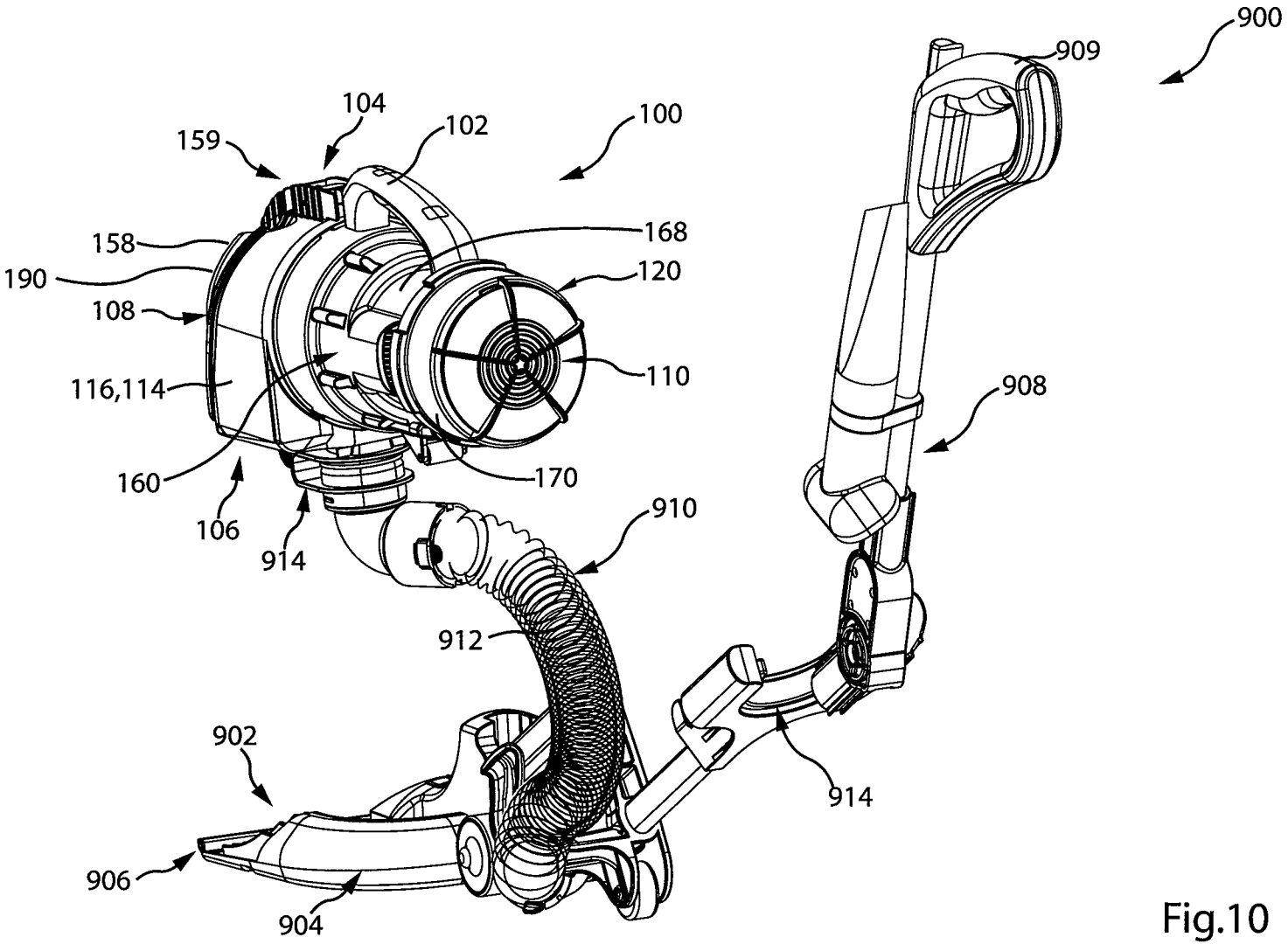
FIG. 10 is a perspective illustration of the surface cleaning unit of FIG. 1 in airflow communication with the surface cleaning apparatus of FIG. 9.

Referring now to FIGS. 9 and 10, in some embodiments, surface cleaning unit 100 is removably mountable in a surface cleaning apparatus. For example, surface cleaning unit 100 may be removably mounted to form a canister type surface cleaning apparatus, or, as shown, an upright surface cleaning apparatus 900. Preferably, as shown, surface cleaning unit 100 is usable as a hand vacuum cleaner, as described hereinabove, as well as being removably mountable in a surface cleaning apparatus. In alternate embodiments, surface cleaning unit 100 may be removably mounted in a surface cleaning apparatus, without being usable as a hand vacuum cleaner. For example surface cleaning unit 100 may not be provided with a surface cleaning nozzle 112, and may serve only as a removable pod of a surface cleaning apparatus.

In the embodiment shown, upright cleaning apparatus 900 comprises a floor cleaning unit 902, which comprises a surface cleaning head 904. The surface cleaning head comprises a dirty air inlet 906. A handle 908 is drivingly connected to the surface cleaning head 904, such that a user may grip the handle 908 and move the surface cleaning head 904 along a surface to be cleaned.

As exemplified, the surface cleaning unit 100 is connectable in airflow communication with the surface cleaning head 904. More particularly, the surface cleaning unit is connectable to the surface cleaning head 904 such that an airflow passage extends from the dirty air inlet 906 of the surface cleaning head to the clean air outlet 120 of the surface cleaning unit 100. For example, as shown, a portion 910 of the airflow passage extends between the surface cleaning head 904 and the surface cleaning unit 100. The portion 910 comprises a flexible conduit 912, which in the embodiment shown is hose. An attachment member 914 is provided, which connects the flexible conduit 912 to the cyclone unit 114 of the surface cleaning unit.

As exemplified, the surface cleaning unit 100 is removably mounted to and supported by handle 908, which extends upwardly from the floor cleaning unit 902 and comprises a handgrip 909. Preferably, handle 908 comprises a mount 914. In the embodiment shown, mount 914 comprises a U-shaped recess. The attachment member 914 is lockably receivable in the U-shaped recess, to mount the surface cleaning unit 100 to the handle 908 such that, the cyclone unit 114 and the suction motor 164 are supported by the handle 908.

In the exemplified embodiment, the attachment member 914 mounts the cyclone unit 114 to the handle 908. In alternate embodiments, any other portion of the surface cleaning unit 100, such as the motor housing 168, or the handle 102, may be mounted to the handle 908. Further, the portion may be mounted to the handle indirectly, such as via attachment member 914 as shown, or directly. For example handle 102 may be directly received in a mount provided on handle 908.

As can be seen in FIG. 9, preferably, when the surface cleaning unit 100 is mounted to the floor cleaning unit 902, the first cyclone unit 114 is positioned above the suction motor 164. That is, the suction motor 164 is below the cyclone unit 114. Accordingly, the front end 108 of the surface cleaning unit 100 becomes an upper end of the cyclone unit 114, and the openable door 158 is at the upper end of the cyclone unit 114. When the surface cleaning unit 100 is in this configuration, the linear airflow path between the first cyclone unit 114 and the suction motor 164 is generally vertical and flows generally downwardly.

Preferably, surface cleaning unit 100 is operable both when mounted to the floor cleaning unit 902, and when removed from the floor cleaning unit 902. That is, as shown in FIG. 10, the surface cleaning unit 100 may remain in fluid communication with floor cleaning unit 902, even when attachment member 914 is removed from mount 914. Accordingly, a user may hold handle 102 of surface cleaning unit 100 with a first hand, and hold handgrip 909 with a second hand. This may be useful in cleaning hard to reach locations, or small areas.

The invention claimed is:

1. A reconfigurable upright surface cleaning apparatus comprising:

a) an air flow passage extending from a dirty air inlet to a clean air outlet;

b) a floor cleaning unit comprising a surface cleaning head having a front end having the dirty air inlet and a rear end having a driving handle drivingly connected thereto, the driving handle moveable between a storage position and a rearwardly inclined floor cleaning position; and, c) a surface cleaning unit removably mounted to the driving handle and, when mounted to the driving handle with the driving handle in the storage position, the surface cleaning unit has a front side and a rear side, the rear side having a surface cleaning unit air inlet that comprises an opening in an outer rear face of the surface cleaning unit, the surface cleaning unit comprising:

(i) a cyclone unit positioned in the air flow passage, the cyclone unit comprising a cyclone unit air inlet downstream from the surface cleaning unit air inlet and at least one cyclone comprising a cyclone axis, the cyclone unit having first and second ends that are intersected by the cyclone axis;

(ii) a pre-motor filter positioned in the air flow passage downstream from the at least one cyclone; and, (iii) a suction motor positioned in the air flow passage downstream from the pre-motor filter and having a suction motor axis, wherein the reconfigurable upright surface cleaning apparatus is operable in an upright mode in which the surface cleaning unit is mounted to the driving handle and is in air flow communication with the dirty air inlet of the floor cleaning unit, and wherein, the air flow passage comprises an inlet portion that extends from the dirty air inlet of the surface cleaning head to the surface cleaning unit air inlet and, when the reconfigurable upright surface cleaning apparatus is in the upright mode and the driving handle is in the storage position, the inlet portion extends to a maximum elevated position that is below an upper end of the surface cleaning unit, and wherein the reconfigurable upright surface cleaning apparatus is also operable in a portable mode in which the surface cleaning unit is removed from the driving handle and is in air flow communication with the dirty air inlet of the floor cleaning unit.

2. The reconfigurable upright surface cleaning apparatus of claim 1 wherein air travels downwardly through a post motor filter when the driving handle is the storage position and the surface cleaning unit is mounted to the driving handle.

3. The reconfigurable upright surface cleaning apparatus of claim 1 further comprising a post motor filter positioned below the suction motor when the driving handle is the storage position and the surface cleaning unit is mounted to the driving handle.

4. The reconfigurable upright surface cleaning apparatus of claim 3 wherein the post motor filter has an upstream side that faces towards a cyclone unit air outlet.

5. The reconfigurable upright surface cleaning apparatus of claim 1 wherein the driving handle extends in a plane and the surface cleaning unit further comprises a longitudinally extending carry handle which extends in the plane.

6. The reconfigurable upright surface cleaning apparatus of claim 5 wherein the carry handle extends forwardly of the front side of the surface cleaning unit whereby the carry handle is graspable by a user when the surface cleaning unit is removably mounted to the driving handle and the driving handle is in the storage position.

7. The reconfigurable upright surface cleaning apparatus of claim 1 wherein the surface cleaning unit is spaced from the floor cleaning unit when mounted to the driving handle.

8. The reconfigurable upright surface cleaning apparatus of claim 1 wherein the suction motor is provided in a suction body housing and the cyclone unit is removably attachable to the suction body housing.

9. The reconfigurable upright surface cleaning apparatus of claim 1 further comprising a post motor filter having an upstream side and a downstream side and the post motor filter is oriented such that the cyclone axis and the suction motor axis extend through the upstream side and the downstream side.

10. The reconfigurable upright surface cleaning apparatus of claim 9 wherein the cyclone axis and the suction motor axis are aligned.

11. The reconfigurable upright surface cleaning apparatus of claim 9 wherein the cyclone axis and the suction motor axis are coaxial.

12. The reconfigurable upright surface cleaning apparatus of claim 1 wherein the clean air outlet is provided on the front side.

13. The reconfigurable upright surface cleaning apparatus of claim 1 wherein when the reconfigurable upright surface cleaning apparatus is in the upright mode and the driving handle is in the storage position, the maximum elevated position is located at a position of the opening in an outer rear face of the surface cleaning unit.

14. The reconfigurable upright surface cleaning apparatus of claim 1 wherein when the reconfigurable upright surface cleaning apparatus is in the upright mode and the driving handle is in the storage position, the maximum elevated position is located at a position of the cyclone unit air inlet.

15. A reconfigurable upright surface cleaning apparatus comprising:

a) an air flow passage extending from a dirty air inlet to a clean air outlet;

b) a surface cleaning head having a front end having the dirty air inlet and a rear end;

c) an upper section moveably mounted to the surface cleaning head between a storage position and a rearwardly inclined floor cleaning position; and, d) a surface cleaning unit removably mounted to the upper section by a mounting assembly which comprises an attachment member, the attachment member is removably attached to the surface cleaning unit, the surface cleaning unit comprising:

(i) a cyclone unit positioned in the air flow passage, the cyclone unit comprising a cyclone unit air inlet downstream from the surface cleaning unit air inlet and at least one cyclone comprising a cyclone axis, the cyclone unit having first and second ends that are intersected by the cyclone axis;

(ii) a pre-motor filter positioned in the air flow passage downstream from the at least one cyclone; and, (iii) a suction motor positioned in the air flow passage downstream from the pre-motor filter and having a suction motor axis wherein, the surface cleaning unit has a surface cleaning unit air inlet and the air flow passage comprises an inlet portion that extends from the dirty air inlet of the surface cleaning head to the surface cleaning unit air inlet and comprises a flexible conduit, and when the surface cleaning unit mounted to the upper section, the attachment member engages the surface cleaning unit, comprises part of the air flow passage downstream of the flexible conduit and engages a mount on the upper section.

16. The reconfigurable upright surface cleaning apparatus of claim 15 wherein the clean air outlet is provided on the front side.

17. The reconfigurable upright surface cleaning apparatus of claim 15 wherein the cyclone is located forward of the driving handle when the surface cleaning unit is mounted to the upper section.

* * * * *